United States Patent [19]

Kinney

[11] 4,208,366

[45] Jun. 17, 1980

[54] PROCESS FOR PREPARING A NONWOVEN WEB

[75] Inventor: George A. Kinney, West Chester, Pa.

[73] Assignee: E. I. Du Pont de Nemours and Company, Wilmington, Del.

[21] Appl. No.: 956,348

[22] Filed: Oct. 31, 1978

[51] Int. Cl.[2] ..... B06B 1/02; B29D 3/00

[52] U.S. Cl. ..... 264/24; 19/296; 264/164; 425/174.8 E

[58] Field of Search ..... 264/24, 210 F, 164; 425/174.8 E; 250/324, 325; 19/296

[56] References Cited

U.S. PATENT DOCUMENTS

| | | | |
|---|---|---|---|
| 2,070,307 | 2/1937 | Nicholls | 250/325 |
| 2,558,900 | 7/1951 | Hooper | 250/325 |
| 2,917,787 | 12/1959 | Thomas et al. | 19/296 |
| 3,163,753 | 12/1964 | Sabato et al. | 264/24 |
| 3,172,024 | 3/1965 | Gundlach | 250/325 |
| 3,436,797 | 4/1969 | Graf et al. | 264/24 |
| 3,490,115 | 1/1970 | Owens et al. | 264/24 |
| 3,506,744 | 4/1970 | Talbert | 264/24 |
| 3,708,561 | 1/1973 | Horimoto et al. | 264/24 |

*Primary Examiner*—Jay H. Woo

[57] ABSTRACT

A process and apparatus for forming a non-woven web in which a bundle of untwisted filaments are charged upstream of a pair of elastomer-covered counter rotating squeeze rolls and propelled through the nip of the rolls to a moving laydown belt with the assistance of an electrostatic field developed between the rolls and the belt.

1 Claim, 1 Drawing Figure

PROCESS FOR PREPARING A NONWOVEN WEB

DESCRIPTION

1. TECHNICAL FIELD

This invention relates to the preparation of nonwoven webs from continuous filaments and more particularly to a process used to convey the filaments to a collecting surface.

2. BACKGROUND ART

Kinney in his U.S. Pat. No. 3,338,992 disclosed a process by which continuous filaments are collected as nonwoven webs. More partticularly, Kinney discloses a method which utilizes electrostatic charging of continuous filaments just before they are drawn into an air forwarding jet. The filaments issuing from the air jet then fan out due to mutual repulsion due to their charged condition and are deposited in random well-dispersed fashion. In the Kinney process the charged filaments are prevented from attaching themselves on the jet walls by application of sufficient jet air flow. This flow, however, must be limited, because excessive flow tends to disrupt the nonwoven web on the collecting belt (usually a moving screen or fabric). Turbulence of excessive air flows will lift layers of the fibers already laid down and roll them to form light and heavy patches that impose nonuniform web opacity. This action can be reduced by using a vacuum box under the porous belt surface for collection of the filaments to enhance direct passage of the jet air through that surface. These operations become increasingly expensive, however, as jet air flows are increased. In lightweight filament sheets good optical uniformity is particularly difficult to achieve. In addition to the problem of web uniformity, air jets generate high levels of sound. This has raised increasing concern about detrimental effects that high level sound may impose over extended time periods, on the hearing ability of operators that are exposed to it.

The present invention provides a quiet process for depositing a uniform nonwoven well-dispersed filament web at high rates of output.

DISCLOSURE OF THE INVENTION

The process of the invention includes forwarding a continuous bundle of untwisted filaments through an electrostatic charging zone to deposit electrostatic charge on the filaments, then passing these filaments into the nip between two contiguous elastomer covered counter rotating rolls which propel the filaments into an electrostatic field generated between the nip rolls and the collecting surface. The polarity of electrostatic charge placed on the filament must be that of charge that may be transferred to the filaments by tribo contact with the elastomeric nip roll coverings. The electrostatic field between the nip rolls and the collecting surface must be oriented to repel the charged filaments away from the nip rolls and attract them toward the web collecting surface.

The apparatus of the invention includes electrostatic charging means (corona or triboelectric) for applying electrostatic charge to a moving bundle of continuous untwisted filaments, and a pair of contiguous elastomer-covered counter-rotating seismically-mounted propulsion rolls having an electrically grounded conductive core. The rolls form a nip which attenuates the filaments continuously through the electrostatic charging zone and propels them downward into the electrostatic force field toward a collecting surface which preferably is a moving nonconductive belt for collecting filaments in the form of a nonwoven web, and carrying the web continuously out of the electrostatic force field. A high voltage capacitor located underneath the collecting belt, slightly separated from the belt, and dominating the entire width of the collecting area on the collecting belt, provides an electrostatic force field between the nip rolls and the collecting belt.

BRIEF DESCRIPTION OF THE DRAWING

The drawing is a schematic illustration of apparatus used in practicing the invention.

BEST MODE

Figure 1:
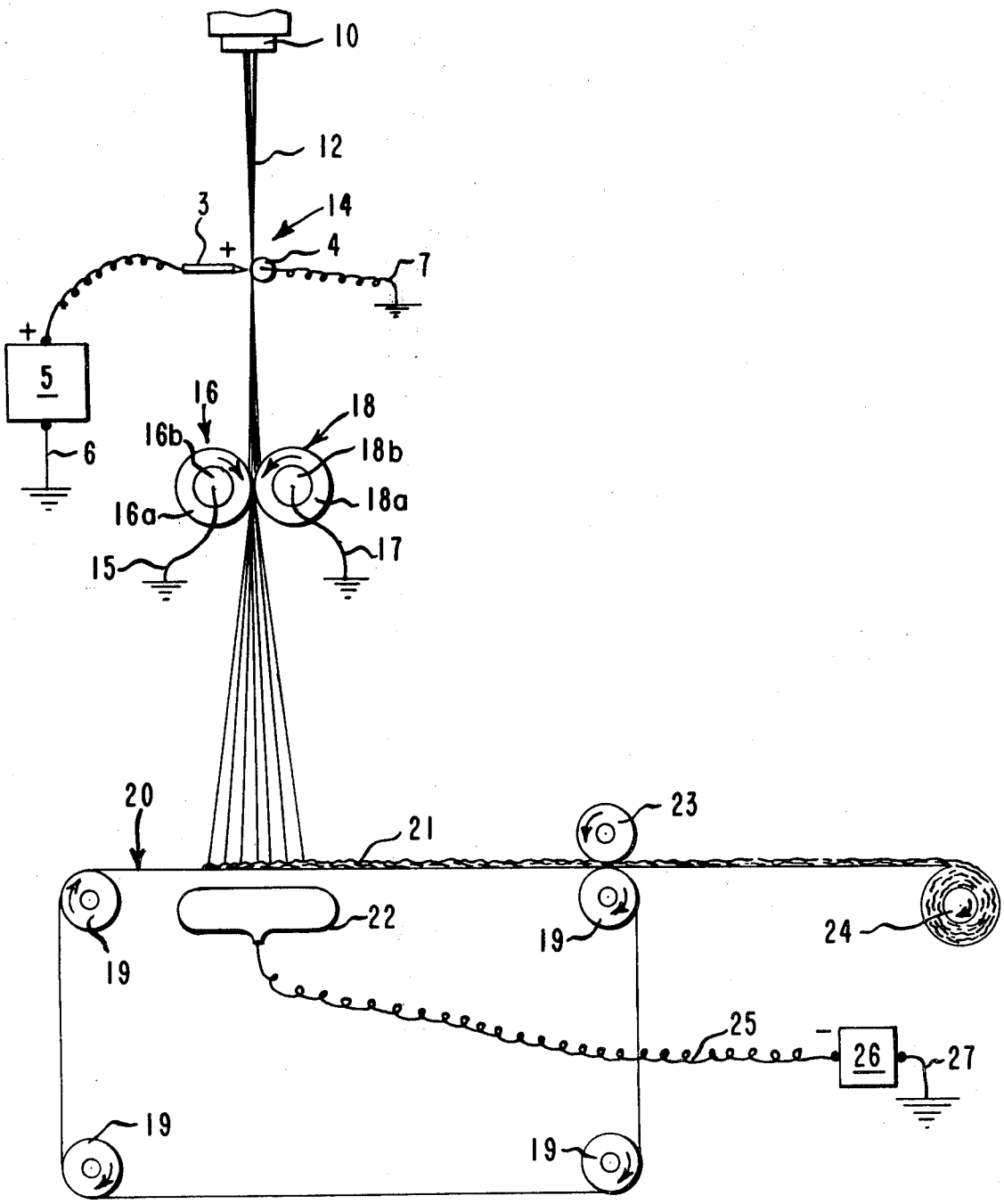

The embodiment chosen for purposes of illustration includes as major components thereof a melt spinning spinneret 10 for extruding filaments 12, an electrostatic charging means generally designated 14, a pair of contiguous electrically grounded counter rotating rolls 16, 18, a moving collecting surface 20 and a high voltage capacitor 22 located underneath the collecting surface 20.

The electrostatic charging means 14 consists of electrode 3 and a target bar 4 that is grounded through connector 7. Electrode 3 consists of a row of needles (only one shown) with their points spaced from and aimed at target bar 4. The needles 3 are connected to voltage generator 5 which is grounded through connector 6. Suitable charging equipment is described in more detail in DiSabato and Owens U.S. Pat. No. 3,163,753.

The rolls 16, 18 have elastomeric coverings **16*a*, 18*a* and conductive cores 16*b*, 18*b* grounded through conductors 15 and 17, respectively. A suitable covering 16*a*, 18*a* consists of a chlorosulfonated polyethylene such as Hypalon® elastomer. The roll coverings are preferably exposed to ultraviolet radiation before being operated to promote a surface structure which readily releases filaments. The covers usually possess a 50 to 70 durometer hardness. The nip pressure between the rolls 16, 18** is sufficient to remove occluded air from the filaments. This prevents wrapping of the filaments around the rolls via entrainment in roll air films at high speeds. The propulsion rolls are seismically mounted, i.e. bearings are mounted in elastomeric blocks or springs to evolve close smooth rotation around their centers of gravity. Bearings of this type are described in Kinney U.S. Pat. No. 3,042,324. The propulsion rolls preferably have a diameter sufficient to allow running at the desired high velocity without undue dynamic or static deflection. For example, rolls 5 cm in diameter and 15 cm long are satisfactory.

A driven collecting belt 20 located below rolls 16, 18 passes around conductive idler rolls 19, which are supported on electrically grounded framing.

An unbonded nonwoven web 21 is collected on the belt 20 and is carried toward roll 24 for windup. In order to provide better web cohesion a high pressure roll 23 is provided at the end of the collecting table. The consolidated web may optionally be heated in steam or hot air as it leaves the collecting belt to provide a thermally bonded web.

A high voltage capacitor 22 located underneath the upper reach of belt 20 is connected by means of connector 25 to a high voltage DC source 26 which is grounded via connector 27. The capacitor 22 and its high voltage source 26 generate an electrostatic force field between the rolls 16, 18 and the capacitor. In a typical arrangement with rolls 16, 18 having dimensions of 5 cm in diameter and 15 cm long and being 50 cm above collecting belt 20, a 200 kilovolt potential is applied between the rolls and the capacitor.

In operation, the filaments 12 are passed directly to the target bar 4 without twisting. Twist is undesirable because it does not permit effective filament separation necessary to the process of the invention. A corona discharge flows between the charged needles 3 and the target bar 4 transferring a charge to the filaments of preferably between 3 to 6 microcoulombs/g but optionally as high as 10 microcoulombs/g. The filaments then pass from the target bar and spread into a wide ribbon prior to entering the nip between rolls 16, 18. These rolls in turn project the filaments into the electrostatic field generated between the rolls and the belt 20 by grounding the rolls and locating capacitor 22 below the belt. The polarity of this field is oriented to repel the charged filaments from the roll surfaces which face the belt 20 and move them swiftly toward laydown on the belt. With this arrangement, the charged filaments approaching the rolls induce an opposite polarity charge in the sections of the rolls surfaces facing the incoming filaments. This charge tends to attract and restring filaments if they break. With grounded rolls, the charge induced in the rolls' surfaces that face the high voltage capacitor also acts to repel the charged filaments from these surfaces and importantly, the strong electrostatic force field generated between the rolls and the capacitor, moves the charged filaments switfly toward the belt against the resistance of ambient room air.

Comparative tests were made between air jet propulsion and nip roll propulsion of corona charged ribbons of filaments at the same filament density per cm of ribbon width in preparing nonwoven fabrics of about 25 $g/m^2$. These tests showed that the roll propulsion process provided much lower noise levels and produced webs having much better optical uniformity than the jet process.

While the best mode describes apparatus that includes rolls 16, 18 having grounded conductive cores and a charged capacitor 22 located underneath laydown belt 20, in the alternative, charging rolls 16, 18 and grounding capacitor 22 will provide satisfactory results.

I claim:

1. In a process for preparing a uniform nonwoven web that includes the steps of forwarding a continuous bundle of untwisted filaments through an electrostatic charging zone to deposit a charge on the filaments and collecting the filaments as a web on a moving collecting surface, the improvement comprising: passing the charged filaments into the nip between two contiguous elastomer covered electrically grounded counter rotating rolls located between the charging zone and the collecting surface; generating an electrostatic field between said rolls and said collecting surface, said electrostatic field having a polarity oriented to repel the charged filaments from the surface of said rolls facing said collecting surface and to move the charged filaments toward the collecting surface; and propelling the charged filaments into said electrostatic field by means of said rolls.

* * * * *